United States Patent [19]

Marechal

[11] 4,176,898

[45] Dec. 4, 1979

[54] ELECTRIC PLUG AND SOCKET CONNECTORS WITH RESILIENT END-PRESSURE CONTACTS AND SAFETY DISC

[75] Inventor: Gilles A. G. Marechal, Paris, France

[73] Assignee: Societe d'Exploitation des Procedes Marechal SEPM, Paris, France

[21] Appl. No.: 890,164

[22] Filed: Mar. 27, 1978

[30] Foreign Application Priority Data

Apr. 15, 1977 [FR] France ..... 77 11433

[51] Int. Cl.[2] ..... H01R 13/44

[52] U.S. Cl. ..... 339/41

[58] Field of Search ..... 339/48, 49 B, 41, 46, 339/88 R, 111

[56] References Cited

U.S. PATENT DOCUMENTS 3,853,376 12/1974 Marechal ..... 339/41

FOREIGN PATENT DOCUMENTS 1301448 7/1962 France ..... 339/111

*Primary Examiner*—Neil Abrams

*Attorney, Agent, or Firm*—Edwin E. Greigg

[57] ABSTRACT

An electric plug and socket connector comprises a base provided with movable contacts resiliently urged towards their contact position, a plug provided with fixed pins, and a rotary safety disc which in its resting position masks the movable contacts and which is provided with as many openings as there are pins on the plug, sized and arranged suitably to enable the pins to pass through them and to become applied end-wise on the movable contacts after rotation of the disc. The angular locking or detention in the resting position and in the contact position of the safety disc is ensured at least in part by projecting insulating elements connected to the movable contacts and urged by the resilient means of the latter to be engaged in the resting position and in the contact position in separate recesses formed in the disc. The recesses determining the latter position are substantially coaxial with the openings of the disc while the surfaces and shapes respectively of the projecting elements and of the recesses, are suitably chosen to cooperate and to enable the obtaining by a maneuver of simple rotation of the disc, at the beginning and at the end of the maneuver, respectively, withdrawal of the elements and an engagement of the latter in the recesses. Arcing effects are thereby minimized.

6 Claims, 6 Drawing Figures

ELECTRIC PLUG AND SOCKET CONNECTORS WITH RESILIENT END-PRESSURE CONTACTS AND SAFETY DISC

BACKGROUND OF THE INVENTION

1. Field of the Invention

The invention relates to an electric plug and socket connector provided with resilient end-pressure contacts.

When it is a matter of interrupting the passage of a current in a circuit under voltage, the only known manner is to separate and to space apart two elements of said circuit. However, after the separation, the current continues to pass through an arc which sparks between the points of separation. This electric arc is constituted by a flow of electrons and by a flow of ions in reverse directions, created by the electric field which exists between the two separated parts of the circuit. This arc is all the greater as the electric field is more intense and results in numerous drawbacks of which one notably is rapid deterioration of the contact elements.

2. Description of the Prior Art

Numerous cutoff devices have been devised to render this arc unstable as rapidly as possible. Such switches or circuit-breakers call upon various techniques: switches with insulating plates, circuit-breakers with magnetic blow-out, with air sweep to remove the ionized particles and to cool the plasma, oil cut-off, vacuum cut-off, etc. In addition, it is clear that one parameter of attenuation is the speed of cut-off which enables the electric arc to be drawn out rapidly.

All these switches are intended to equip heavy current circuits, and in addition can be arranged upstream of a contacter which controls said switch by means, for example, of pilot wires so that the level of said contacter, the closing and opening, is carried out without voltage.

It is evident that such means can not be contemplated to cooperate with or equip electrical connectors of average or low current, for industrial or domestic use. The latter are, however, also subject to the disturbing influences of electric arcs, and up to the present no means of weakening electric arcs has been produced, which considerably limits the life span of conventional power sockets through the inevitable wear of the contacts and of the insulating elements which results from such arcing.

Accordingly, it is a particular object of the invention to provide an electrical plug and socket connector capable of reducing the effects of the cut-off arc.

Such connectors or power sockets comprise a fixed socket, base or housing, connected to the installation and a movable plug connected to the supply cable. For obvious safety reasons, certain bases are provided with a protective disc, also called safety disc, which is mounted on the base so as to hide in the resting or in the inactive position, the energized contacts. These discs have as many openings as there are contacts so that simple rotation enables said contacts to be uncovered. They are locked or detained in the resting or in the inactive position and generally unlocked and rotated by manipulating the plug. Known locks or detents consist, for example, in the cooperation of a small piston or pin urged by a spring towards a locking position and of a conjugate housing formed in the disc so as to subject the latter to rotation with the base, said piston or pin being disengageable from its housing by an element of the plug.

The contacts of the plug and of the socket or base can be constituted respectively by pins and by recesses or bushes. However, the contacts of the base can also be constituted by resilient end-pressure contacts.

It is another object of the invention to provide a plug and socket electrical connector constituted by a fixed pin plug and a base having movable resilient end-pressure contacts and a safety disc of the type described above which is locked or indexed in position at least in part at the rest and at the contact positions, by the resilient action of the movable contacts of the base.

GENERAL DESCRIPTION OF THE INVENTION

To achieve these objects, the invention provides a plug and socket electrical connector of the type mentioned above, wherein said locking is ensured at least in part by projecting insulating elements connected to the movable contacts and urged by the resilient means of the latter to be engaged in the resting and in the contact position in distinct recesses formed in the disc, the recesses determining the latter position being substantially coaxial with the openings of the disc, whilst the surfaces and shapes respectively of said projecting elements and of the recesses are selected suitably so as to cooperate with and to permit obtaining, by simple rotation of the disc, at the beginning and at the end of the maneuver, respectively, withdrawal of said elements and engagement of the latter in the recesses.

Hence, this embodiment enables one to obtain a plug and socket electrical connector with a safety disc which is locked angularly in the resting and in the contact positions by the movable contacts themselves or intermediate parts connected with them, which provides the advantage of eliminating the burdensome locking means mentioned above.

In addition, the cut-off arc is attenuated by at least two effects achieved by the invention. Firstly, it is clear that the unlocking of the disc on cut-off is obtained by a certain force at the beginning of the rotary maneuver to enable the projecting elements of the contacts to be withdrawn against the resilient force urging them, which results in an increased speed of the rotation which immediately follows the unlocking and hence an even more sudden stretching of the electric arc.

An attenuation is also obtained by the presence of said projecting elements in the region of the formation of the arc and which thus constitute baffles of insulating material for the arc or at least a partial shield until the complete covering of the base contacts by the safety disc.

Advantageously the projecting elements of the movable contacts are constituted by bushings or the like whose end is bevelled so as to present a substantially frustoconic surface and wherein the recesses have a substantially frustoconic cup shape of the same slope as said bushings so that at the beginning of a rotation maneuver, the conjugate surfaces or a part of the latter, of the recesses and of the bushings slide against one another resulting in the withdrawal by translation of said bushings.

BRIEF DESCRIPTION OF THE DRAWINGS

The invention will be better understood and other features will appear on reading the description which follows and on examining the accompanying drawing in which.

DESCRIPTION OF A PREFERRED EMBODIMENT

Figure 1:
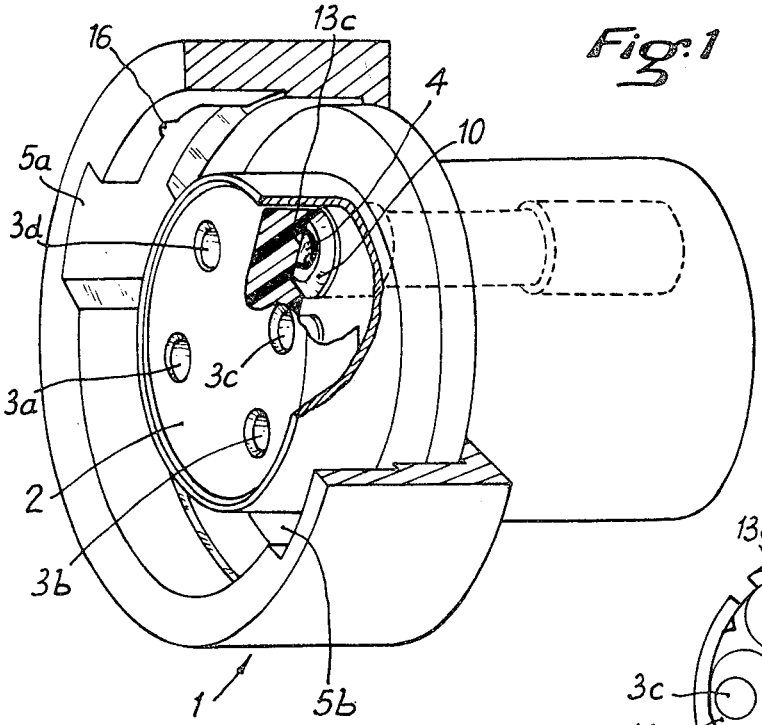
FIGS. 1 and 2 show diagrammatically in perspective an embodiment of a part of a base of a plug and socket electrical connector according to the invention, the safety disc being shown respectively in the resting and in the contact position.
Figure 2:
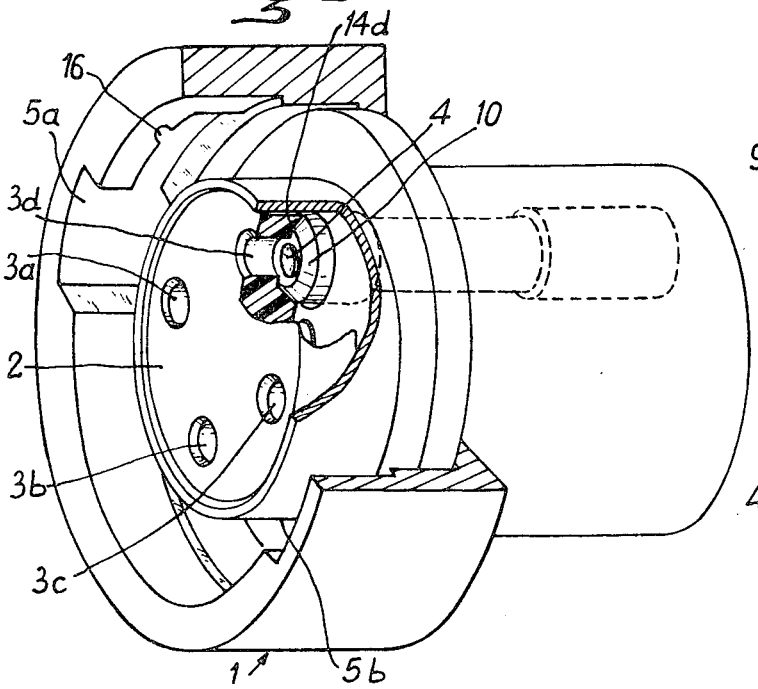

FIGS. 1 and 2 show a base 1 of an embodiment of a plug and socket electrical connector according to the invention provided with a safety disc 2 rotatably mounted on said base. This disc 2 is provided with openings 3*a* to 3*d*, here four in number. Behind this safety disc are arranged four resilient movable contacts such as 4 in a relative position similar to that of the openings 3 and constituting here three phase contacts and a ground contact.

Figure 6:
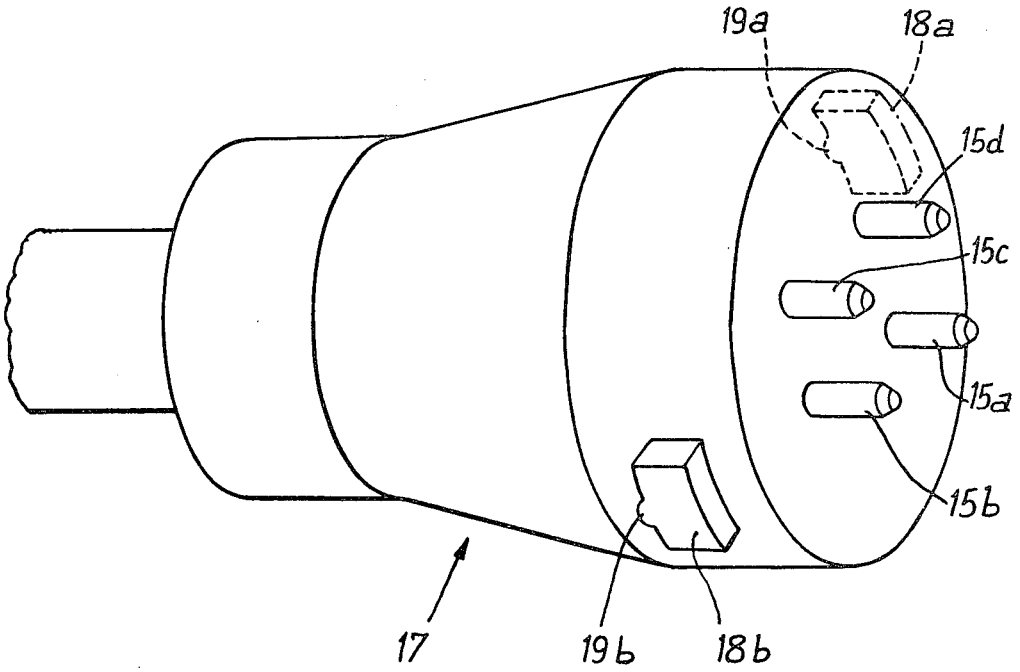
FIG. 6 shows in perspective and diagrammatically a conventional plug for connecting with the base shown in FIGS. 1 and 2.

The disc 2 in FIG. 1 is in a resting or inactive position and has an angular position such that the contacts 4 are masked. The base 2 is adapted to receive a plug 17 (FIG. 6) provided with fixed pins (15*a* to 15*d*) positioned and sized so as to pass through the openings 3, and to rotate the disc 2 until the openings 3, the contacts 4 and the pins 15 are aligned in such a way that contact can be established (position of FIG. 2). To this end the plug 17 is provided with two different and diametrically opposite lateral stubs or stops 18*a* and 18*b* adapted to be engaged in the grooves 5*a*, 5*b* formed in the base. The stubs 18*a* and 18*b* of the base are different to oblige the operator to present the plug in proper position and the grooves 5*a* and 5*b* have a general L shape so as to enable a first translation movement of the plug, followed by a rotary movement, to a position which is thus limited and cannot be passed.

Figure 3:
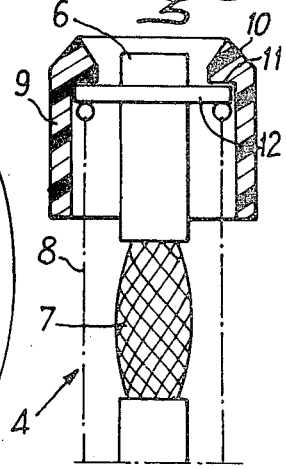
FIG. 3 is a partial view in section of a resilient contact of an embodiment of a base according to the invention.

The contacts 4 are resilient end-pressure contacts and comprise (see FIG. 3) a movable head 6 provided with a tablet of silver, a conducting tress 7 and a spring 8. The head 6 of each contact 4 is surrounded by an insulating bushing 9 whose projecting end is bevelled to constitute a frustoconic angular surface 10. The bushing 9 has an inner shoulder 11 which is applied to a collar 12 of the contact head on which the action of the spring 8 is exerted so that the latter urges the whole of the contact head and the bushing 9 towards the contact position and in addition the bushing 9 and the head 6 are fast in translation when pressure is exerted on the bushing 9.

Figure 4:
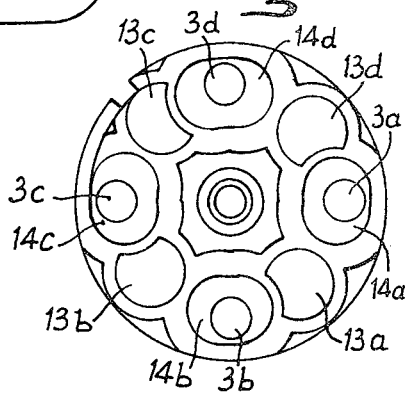
FIG. 4 shows the surface turned toward the contacts of the base of a safety disc according to the invention.

The disc 2 is provided on its masked surface shown in FIG. 4 with recesses in the form of cups 13*a* to 13*d* and 14*a* to 14*d*. The latter are substantially coaxial respectively with the openings 3*a* to 3*d* whilst the recesses 13*a* to 13*d* are arranged between the latter with the same relative arrangement, FIGS. 1 and 2 showing respectively the recesses 13*c* and 14*d*. The recesses 13 shown do not have a completely cylindrical mouth. This construction is in fact due to problems of size of the elements and it is obviously possible to conceive all sorts of shapes and notably recesses in the form of substantially radial grooves. The inner surfaces of the recesses 13 and 14 are preferably conical and of the same slope as the surfaces 10 of the bushings 9. They must be suitable in any case to cooperate with said surfaces 10 in the manner which will be described below.

As has already been stated, at rest the disc 2 is in the position shown by FIG. 1 in which the contacts 4 are masked. In this position the bushings 9 of the contacts 4 urged by the springs 8 are pushed into the recesses 13*a* to 13*d* so that the disc 2 is locked or at least detained in position. When the plug 17 is pushed into the socket and then rotated in a clockwise direction, a resistance has to be overcome at the beginning of the maneuver so that the surfaces 10 of the bushings 9 and the inner surfaces of the recesses 13 slide over one another and cause a translation of said busings and hence of the contact heads until the ends of the bushings are completely disengaged from the recesses 13 and slide on the inner surface of the disc 2. When the maneuver is continued the bushings 9 become suddenly positioned in the recesses 14 and the contact heads 6 become applied on the pins of the plug. This position is hence also indexed and locked by the contacts 4.

The embodiment shown relates to a connector for a three phase current with a ground connection. The three phase contacts are spaced angularly by 90 degrees whilst a slight offset is formed for the ground contacts so that for safety reasons the latter is touched lightly before the phase contacts by the corresponding pin and in the same way separated last when the plug is withdrawn. It is obvious that the invention includes any conceivable arrangement for any type of current.

Figure 5:
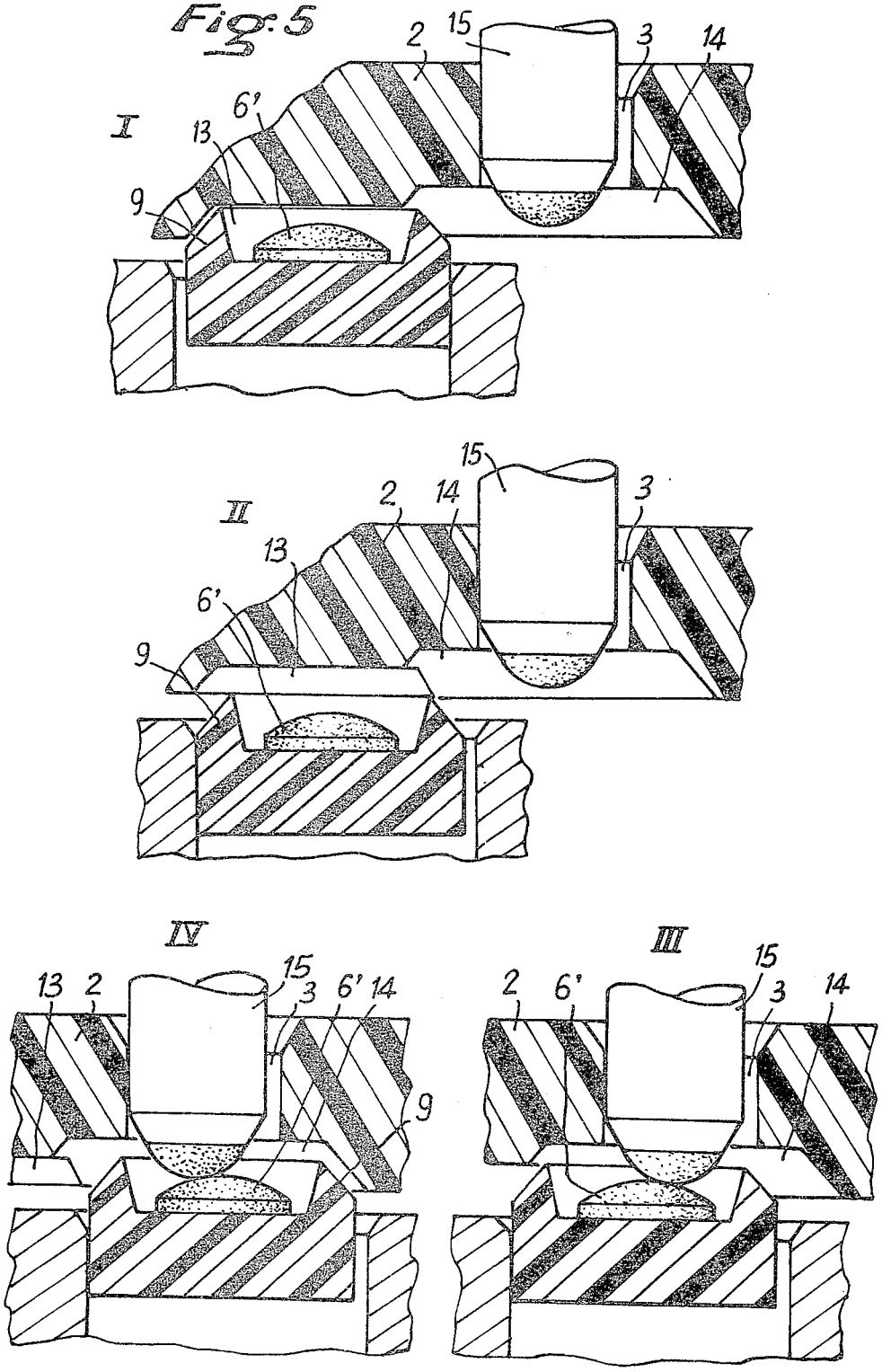
FIG. 5 shows diagrammatically the principle of operation of an embodiment of a plug and socket connector according to the invention by showing several successive stages of the rotation of the safety disc.

FIG. 5 shows diagrammatically the operation which has just been described showing four distinct phases thereof I, II, III and IV. This diagram shows a base contact, here having a head 6' of spherical shape provided with a bushing 9 as well as with a pin 15 of the plug intended to cooperate with the base or socket. The disc 2 has a housing with a recess 14 coaxial with the opening 3 traversed by the pin 15. Phase I is the resting or initial phase in which bushing 9 is in the recess 13. A slight rotation and the bushing 9 withdraws (phase II). At phase III the contact is re-established, the bushing 9 occurring in the recess 14. However, the rotation is not complete and must be continued to make a total of 45 degrees (phase IV), thus forcing the contact heads 6' and the pins 15 to rub against one another and hence to be self-cleaning which improves the passage of the current.

The cut-off operation is carried out by a reverse maneuver, that is to say by an anti-clockwise rotation and a withdrawal of the plug. It is clear that then the bushings 9 will pass the recesses 14 up to the recesses 13 where they will be detained in the resting position. The force necessary at the beginning of the maneuver to withdraw the contacts 4 from the recesses 14 results as has been shown by an acceleration in the separation of the elements in contact and hence an attenuation of the electrical cut-off arc. The diagrammatic FIG. 5 shows in addition that at the moment of cut-off the conical ends of the bushings 9 constitute at least partially a shield against the electric arc.

FIGS. 1 and 2 show in addition that the grooves 5*a* and 5*b* have in their circumferential part a small notch 16 designed to receive a protuberance 19*a*, 19*b* formed on the plug 17 or on the stubs 18*a* and 18*b* of the latter (FIG. 6) so as to render more accurate and/or reinforce the contact position. The conjugate shapes of the notches 16 and of the protuberances 19*a*, 19*b* are such that a rotary force suffices to disengage them.

Numerous modifications can be introduced without departing from the scope of the invention. The principle resides essentially in the introduction of an insulating material connected to the movable contacts in recesses or the like formed on the safety disc in a resting position for which the contacts are masked and in a contact position or operating position.

We claim:

1. An electric plug and socket connector comprising: a base; a rotary safety disc mounted on the base, said disc defining a plurality of contact positions and a plurality of recesses; a plurality of movable contacts resiliently urged towards a respective one of the contact positions; projecting insulating elements connected to the movable contacts; and a plug provided with fixed pins, wherein said rotary safety disc masks the movable contacts when in its resting position, and is provided with as many openings as there are pins on the plug, sized and arranged suitably to enable said pins to pass through said openings and to become applied end-wise on the movable contacts after rotation of the disc, wherein said plug and socket is adapted so that the angular locking or detention in the resting position and in the contact position of the safety disc is ensured, at least in part, by the same projecting insulating elements, and urged by the resilient means of the latter to be engaged in the resting position and in the contact position in the separate recesses formed in the disc, and wherein the recesses determining the latter position are substantially coaxial with the openings of the disc while the surfaces and shapes respectively of said projecting elements and of the recesses are suitably chosen to cooperate and to enable the obtaining by a rotation of the disc, at the beginning and at the end of the rotation, respectively, withdrawal of said elements and an engagement of the latter in the recesses.

2. The electric plug and socket connector according to claim 1, wherein the projecting elements of the movable contacts are constituted by bushings whose ends are bevelled so as to present a substantially frustoconic surface, and wherein the recesses have a substantially frustoconic cup shape of the same slope as said bushings so that at the beginning of a rotational movement, the conjugated surfaces or a part of the latter, of the recesses and of the bushings, slide against one another resulting in the withdrawal by translation of said bushings.

3. The plug and socket connector according to claim 1, wherein the base is provided with at least one stop, wherein at least one stub is formed on the plug to cooperate with said at least one stop so as to limit the rotation of the disc from passing beyond the contact position, and wherein complementary means for detention or locking in this position are arranged to render this position more precise and/or firmer.

4. The plug and socket connector according to claim 3, wherein said complementary means are in the form of at least one protuberance formed on the plug and at least one notch of the base.

5. The plug and socket connector according to claim 3, wherein said complementary means are in the form of at least one protuberance formed on the stubs of the plug and at least one notch of the base.

6. An electric plug and socket comprising: resilient means; a socket with movable contacts urged by said resilient means from a resting position towards a contact position; a plug provided with fixed pins;

a rotary safety disc arranged in the said socket and having openings corresponding in size, number and position with said fixed pins and arranged to be traversible by said pins;

projecting insulating elements connected to the movable contacts and urged by said resilient means to be engaged in said resting position and in said contact position in separate recesses formed in said disc, the recesses determining the contact position being substantially coaxial with said openings;

said disc in the resting position masking said movable contacts;

said projecting elements and said recesses having cooperating surfaces and shapes respectively;

whereby a rotation of the plug relative to the socket causes simple rotation of the disc so that at the beginning and end of the rotation, respectively, said projecting elements are withdrawn from the recesses, and engaged in the other recesses, causing, respectively, withdrawal from, and end-wise application on said movable contacts, of said pins.

* * * * *